United States Patent [19]

Green

[11] Patent Number: 4,705,231

[45] Date of Patent: Nov. 10, 1987

[54] YARN CARRIER HOLDER

[75] Inventor: Jerry T. Green, Hixson, Tenn.

[73] Assignee: Tuftco Corporation, Chattanooga, Tenn.

[21] Appl. No.: 38,754

[22] Filed: Apr. 15, 1987

[51] Int. Cl.[4] ..... B65H 49/04; B65H 49/36

[52] U.S. Cl. ..... 242/130; 242/131; 248/316.1; 269/86; 269/254 MW

[58] Field of Search ..... 242/130, 130.1, 130.2, 242/130.3, 130.4, 131, 131.1, 129.5, 129.7, 129.71, 46.2, 46.3, 46.4, 46.6, 46.7; 248/316.1, 316.2, 316.3, 316.5, 309.1; 269/47, 48, 86, 87, 216, 237, 238, 239, 254 MW

[56] References Cited

U.S. PATENT DOCUMENTS

| | | | |
|---|---|---|---|
| 924,891 | 6/1909 | Curfew et al. | 242/46.7 |
| 1,882,950 | 10/1932 | Rulon, Jr. | 242/46.2 |
| 1,897,716 | 2/1933 | Adsit | 242/46.7 |
| 3,168,996 | 2/1965 | Vossen | 242/131 |
| 4,399,957 | 8/1983 | Singer | 242/130 |
| 4,556,178 | 12/1985 | Singer | 242/130 |
| 4,648,564 | 3/1987 | Wright, Jr. | 242/130 |

*Primary Examiner*—Stanley N. Gilreath
*Attorney, Agent, or Firm*—Harrington A. Lackey

[57] ABSTRACT

A holder for a yarn package or yarn carrier including a support member to which is fixed a clamp member having a bottom jaw surface and a bell crank member pivotally supported upon the support member below the clamp member, so that the rearward and upward projecting leg of the bell crank member constitutes a pivotal clamp member for clamping the lip of the yarn carrier against the fixed clamp member and the longer, forward projecting lever arm leg of the bell crank member provides a support for the interior of the yarn carrier.

7 Claims, 4 Drawing Figures

YARN CARRIER HOLDER

BACKGROUND OF THE INVENTION

This invention relates to a yarn carrier holder, and more particularly to a holder which automatically clamps and supports a yarn carrier.

In the textile industry, including the tufting industry, a yarn package includes yarn wound upon a carrier having a hollow core, such as a cone, spool or bobbin.

A plurality of these yarn packages are held by a creel and the yarn is pulled from these packages to a production machine, such as a loom, knitting machine or tufting machine. typically, creels have included long pins for receiving the yarn packages. In some instances, the pins are hinged so that they may be swung to facilitate loading and unloading the yarn package upon the pins.

Another form of yarn carrier holder includes springs for insertion into the hollow cores of the yarn packages. Such spring-type holders make it difficult for the operator to load and unload the yarn packages on the holders. Sometimes it is even more difficult to load and unload the spring-type holders when they are mounted overhead, and in situations in which most of the operators are women.

Examples of some prior yarn bobbin or cone holders are illustrated in the following U.S. Patents:

U.S. Pat. No. 1,882,950, Rulon, Oct. 18, 1932
U.S. Pat. No. 3,168,996, Vossen, Feb. 9, 1965
U.S. Pat. No. 4,399,957, Singer, Aug. 23, 1983
U.S. Pat. No. 4,556,178, Singer, Dec. 3, 1985

The above Rulon U.S. Pat. No. 1,882,950 discloses a bobbin holder including three circumferentially spaced, rockable fingers 4. As the bobbin is moved toward the mounting flange 3, the edges 13 of the fingers 4 are moved radially inward to force radially outward the opposite ends 11 of the fingers 4.

The Vossen U.S. Pat. No. 3,168,996, discloses a yarn cone holder including angular springs 47 in FIG. 1 which appear to operate on a principal similar to the rockable arms disclosed in the above Rulon patent.

Both Singer patents disclose a yarn bobbin or cone holder which includes a fixed upper clamp member and a pivotal lower clamp dog or member biased toward the fixed clamp member by a spring for the purpose of clamping the upper portion of the lip of a yarn cone or bobbin. In order for the clamp members to release the clip, a releasing lever is provided, which must be manually depressed in order to move the lower clamp member away from the upper clamp jaw. In addition, the Singer U.S. Pat. No. 4,556,178 (FIG. 2) discloses the forward projecting mounting bracket 10', which is fixed relative to the mounting plate and the clamp members.

SUMMARY OF THE INVENTION

The yarn carrier holder made in accordance with this invention includes a vertical support member or mounting plate to which is fixed an upper clamp member having a lower jaw surface. Also mounted on the support member below the upper clamp member is a lower bracket pivotally supporting a bell crank member including an upward and rearward projecting movable lower clamp or jaw member and a much longer forward projecting lever support arm. A yarn package, such as a yarn cone having an annular base or lip is thrust rearward so that the upper portion of the lip is inserted between the movable clamp member and the jaw surface until securely clamped by the two. The lower clamp member is normally biased upward toward the jaw surface by the weight of the forward projecting lever support arm. After the lip is inserted between the clamp members, the weight of the yarn package bearing down upon the lever support arm results in an additional downward force to increase the clamping pressure of the movable clamp member against the lip and the fixed jaw surface.

The yarn package may be easily inserted upon the holder and released from the holder by merely forcing the yarn cone rearward for clamping, and pulling the yarn cone forward for releasing, without any other operation, either manually or mechanically.

DESCRIPTION OF THE PREFERRED EMBODIMENT

Figure 1:
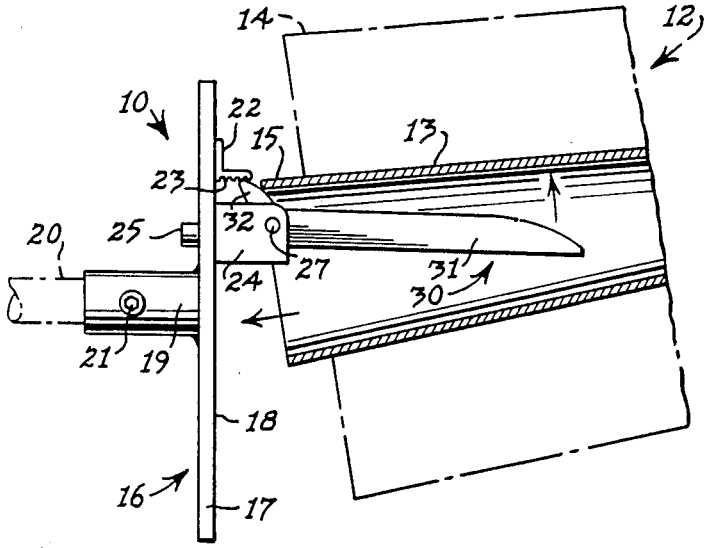
FIG. 1 is a side elevational view of the yarn package holder in its inoperative position and a yarn package shown in section preparatory to being clamped by the holder.

Referring now to the drawings in more detail, the yarn carrier holder 10 made in accordance with this invention is designed to receive and automatically clamp or release a yarn package 12 including an elongated core, such as the cone 13 upon which is wound the yarn 14. In the winding of the package 12, the base of the yarn 14 terminates a short distance from the base of the cone 13 to provide an annular base or lip 15.

The holder 10 includes a support member 16, which may take the form of a rectangular base plate 17 having a front flat or planar surface or face 18 and a rearward projecting mounting sleeve 19 adapted to receive and be supported by a pin or rod 20 secured to a fixed support, such as a creel, not shown. The sleeve 19 may be secured to the support rod 20 by the set screw 21, (FIGS. 1 and 2) if desired.

Fixed to the upper portion of the front face 18 of the support plate 17 is a clamp member 22 which projects forward from the support plate 17 and is provided with a lower or bottom facing clamp or jaw surface 23, preferably serrated, as disclosed in the drawings. Also as disclosed in the drawings, the clamp member 22 may be an angle piece rigidly secured to the front surface 18, such as by welding.

Fixedly secured to the front surface 18 of the support plate 17, slightly below the upper clamp member 22, by a bolt 25, is a journal bracket 24. The journal bracket 24 disclosed in the drawing is U-shaped in a horizontal plane to provide a pair of forward projecting, transversely spaced ears 26.

Figure 3:
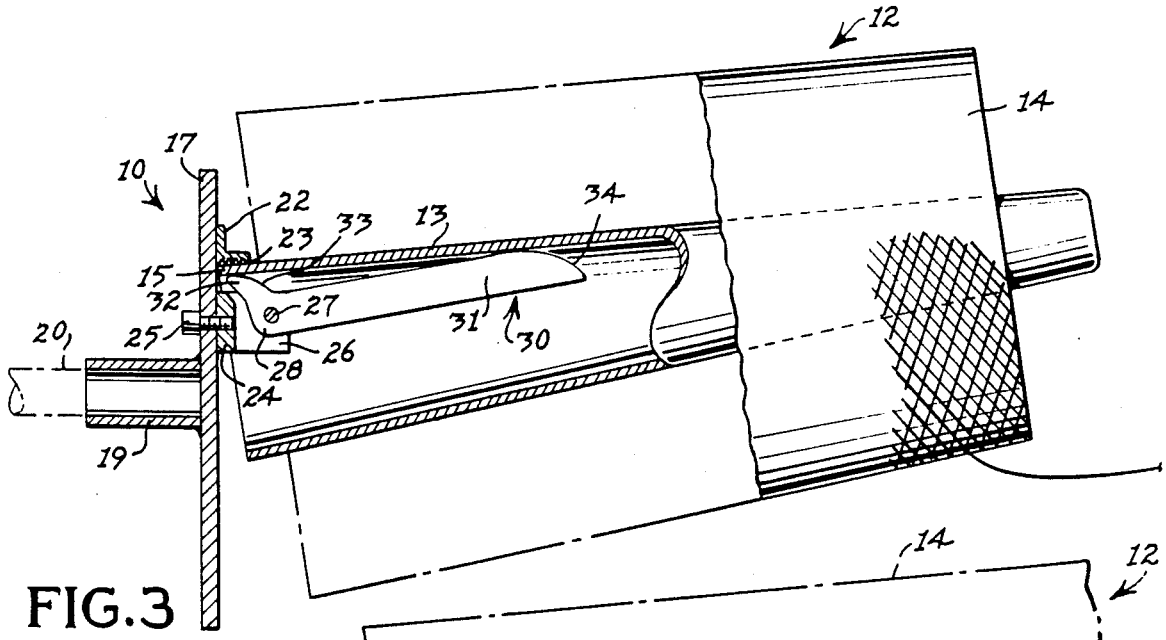
FIG. 3 is an enlarged section taken along the line 3—3 of FIG. 2, with the yarn package shown in section and fragmentarily, in operative clamping position.
Figure 4:
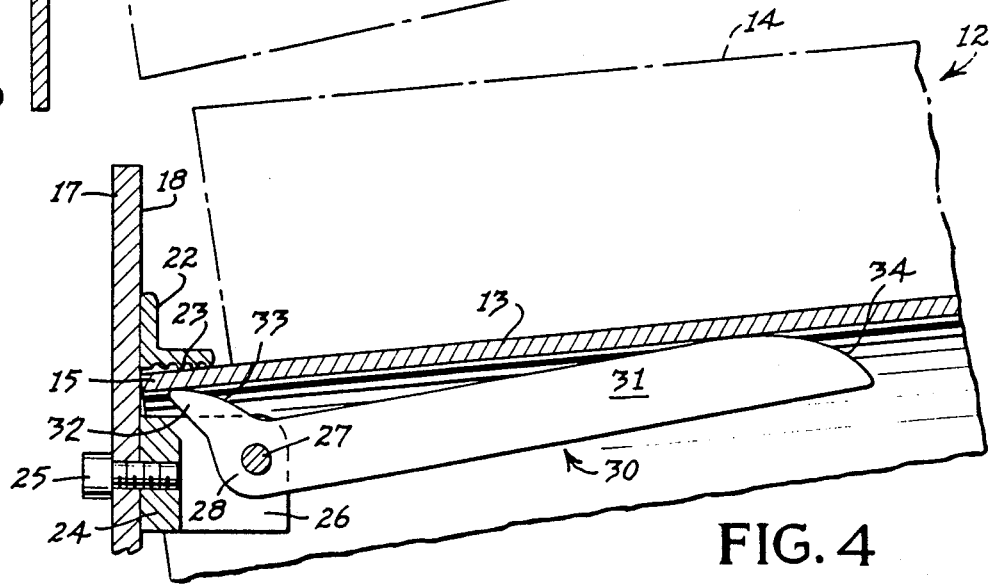
FIG. 4 is an enlarged fragmentary sectional view of the upper portion of the holder and the yarn package.

Journaled between the ears 26 of the bracket 24 by transverse pivot pin 27 is the journal portion 28 of a bell crank member 30. The bell crank member 30 includes a pair of arms projecting at an angle from the journal portion 28. One of the arms is an elongated lever support member 31 which projects forward, normally to be received within the open base end of the cone 13 and to provide a support for the inner surface of the upper portion of the cone 13, as best disclosed in FIGS. 3 and 4. The other leg of the bell crank member 30 projects upward and rearward to form a movable clamp or jaw member 32 biased toward engagement with the bottom jaw surface 23 of the clamp member 22, as illustrated in FIGS. 1, 3, and 4. The upper surface of the jaw member 32 is longitudinally arcuate, convex upward, to form a cam surface 33. The upper surface of the front end portion of the support arm 31 may also define an upward convex cam surface 34 for guiding the base or lip 15 of the cone 13 up and over the support arm 31.

Figure 2:
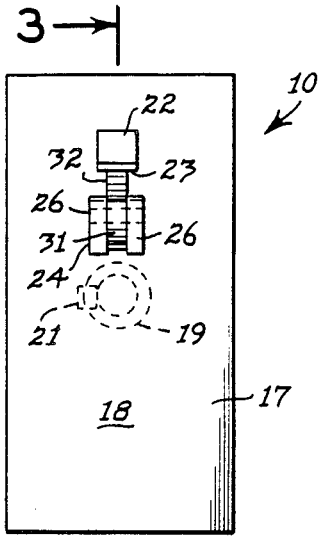
FIG. 2 is a front, elevational view of the holder disclosed in FIG. 1, with the yarn package removed.

In the operation of the holder 10, the support member 16 is secured in a fixed position upon any desired mounting support, such as the support rod 20, so that the plate 17 is substantially vertical with the fixed clamp 22 uppermost. When the yarn holder 10 is not supporting a yarn package 12, the weight of the lever support arm 31 causes the bell crank member 30 to rotate clockwise about the pivot pin 27 causing the jaw member 32 to swing upward until it engages the jaw surface 23 of the fixed clamp member 22, as illustrated in FIGS. 1 and 2.

In order to mount a yarn package 12 upon the holder 10, the yarn package 12 is disposed in a substantially horizontal attitude, as illustrated in FIGS. 1, 3, and 4, and the large or base end of the cone 13 is moved rearward over the bell crank member 30, so that the lever support arm 31 enters the open base end of the hollow cone 13, as illustrated in FIG. 1. Rearward movement of the package 12 is continued until the annular lip 15 engages the cam surface 33 of the movable jaw member 32. Simultaneously, the lip 15 rides up and over the jaw cam surface 33, while forcing downward the movable jaw member 32 permitting the upper portion of the lip 15 to be inserted between the depressed jaw member 32 and the fixed jaw surface 23. Preferably, the cone 13 is moved rearwardly until its rear edge abuts the face surface 18 of the support plate 17, as illustrated in FIGS. 3 and 4. Simultaneously, as the movable jaw member 32 is depressed, the entire bell crank member 30 is caused to rotate in a counter-clockwise direction about the transverse pivot pin 27, causing the lever support arm 31 to rise and support the inner surface of the upper portion of the cone 13, as illustrated in FIGS. 3 and 4.

Thus, in the operative position of the holder 10, as llustrated in FIGS. 3 and 4, the upper rear portion of the lip 15 is squeezed or clamped between the clamp members 32 and 22, the upper inner surface of the cone 13 is supported upon the upper surface of the lever support arm 31, and the entire weight of not only the lever support arm 31, but also, the entire yarn package 12, including the cone 13 and the yarn 14, forces the lever support arm 31 downward about the pivot pin 27 to create additional pressure of the clamp member 32 against the upper portion of the lip 15 and the fixed clamp or jaw surface 23.

When it is desired to release the cone 13 from the holder 10, usually after the supply of yarn 14 has been exhausted from the package 12, the cone 13 is merely manually lifted at its front end to relieve the weight of the cone 13 upon the lever support arm 31, and the cone is pulled forward to pull the lip 15 forward out from between the clamp members 32 and 22. The release of the cone 13 from the jaw member and the clamp member is facilitated by the removal of the weight from the lever support arm 31.

Thus, a yarn carrier holder 10 has been developed which facilitates the mounting and release of the yarn cone 13 relative to the holder 10, without any other manual or mehanical operation than the manual manipulation of the cone 13 itself.

Not only will the weight of the lever support arm 31 and the weight of the yarn package 12 tend to increase the pressure between the jaw member 32 and the clamp member 22, but also, sometimes the downward tension of the thread 14 as it is pulled from the package 13 creates additional downward force upon the lever support arm.

What is claimed is:

1. A holder for supporting a yarn carrier including a hollow core having an annular lip, comprising:

(a) a support member having a front portion, (b) a clamp member fixed to and projecting forward from said support member and having a downward facing jaw surface, (c) a bell crank member having a journal portion, a movable clamp member projecting from said journal portion, and an elongated lever arm projecting from said journal portion at an angle to said movable clamp member, (d) bracket means fixed to said support member, (e) journal means pivotally connecting said journal portion to said bracket means for pivotal movement about a transverse pivotal axis, said lever arm extending freely forward of said support member and said movable clamp member projecting upward toward said jaw surface, so that the weight of said lever arm normally pivots said movable clamp member upward toward clamping engagement with said fixed jaw surface, (f) said lever arm engaging the upper, inner surface of the hollow core of a yarn carrier when the lip of the core is inserted between said clamp members.

2. The invention according to claim 1 in which said lever arm is substantially longer than said movable clamp member.

3. The invention according to claim 2 in which said movable clamp member has an upper cam surface.

4. The invention according to claim 3 in which said upper cam surface is longitudinally arcuate, convex upward.

5. The invention according to claim 1 in which said movable clamp member projects upward and rearward from said pivotal axis.

6. The invention according to claim 1 in which said support member has a front abutment surface between said clamp members against which said lip may abut when received between said clamp members.

7. The invention according to claim 6 in which said support member comprises a vertical support plate comprising said front abutment surface.

* * * * *